US010561878B2

(12) United States Patent
Wu

(10) Patent No.: US 10,561,878 B2
(45) Date of Patent: Feb. 18, 2020

(54) RESISTANCE ADJUSTING APPARATUS WITH WIND RESISTANCE AND MAGNETIC RESISTANCE

(71) Applicant: Mu-Chuan Wu, Tainan (TW)

(72) Inventor: Mu-Chuan Wu, Tainan (TW)

( * ) Notice: Subject to any disclaimer, the term of this patent is extended or adjusted under 35 U.S.C. 154(b) by 150 days.

(21) Appl. No.: 15/902,097

(22) Filed: Feb. 22, 2018

(65) Prior Publication Data

US 2019/0255376 A1 Aug. 22, 2019

(51) Int. Cl.

| | |
|---|---|
| ***A63B 21/00*** | (2006.01) |
| ***A63B 21/008*** | (2006.01) |
| ***A63B 21/22*** | (2006.01) |
| ***A63B 23/035*** | (2006.01) |
| ***A63B 22/06*** | (2006.01) |

(52) U.S. Cl.

CPC .... *A63B 21/00076* (2013.01); *A63B 21/0088* (2013.01); *A63B 21/00192* (2013.01); *A63B 21/22* (2013.01); *A63B 21/4034* (2015.10); *A63B 21/4035* (2015.10); *A63B 22/0605* (2013.01); *A63B 23/03583* (2013.01)

(58) Field of Classification Search

None

See application file for complete search history.

(56) References Cited

U.S. PATENT DOCUMENTS 5,472,392 A * 12/1995 Haan ..... A63B 21/015 188/78
6,106,436 A * 8/2000 Lundahl ..... A63B 21/157 482/1
6,361,477 B1 * 3/2002 Kolda ..... A63B 21/008 188/290
7,052,440 B2 * 5/2006 Pyles ..... A63B 21/0051 482/120
7,833,136 B2 * 11/2010 Bell ..... A63B 21/154 482/138
8,070,657 B2 * 12/2011 Loach ..... A63B 21/15 482/127
8,986,167 B2 * 3/2015 Olsen ..... A63B 21/152 482/51
9,468,798 B2 * 10/2016 Dalebout ..... A63B 22/0664
9,604,099 B2 * 3/2017 Taylor ..... A63B 22/001
9,662,534 B1 * 5/2017 Liu ..... A63B 22/0076
9,987,516 B1 * 6/2018 Chen ..... A63B 22/0285
(Continued)

*Primary Examiner* — Megan Anderson

(74) *Attorney, Agent, or Firm* — Birch, Stewart, Kolasch & Birch, LLP

(57) ABSTRACT

A resistance adjusting apparatus is disposed on a frame and has a rotating member, a magnetic resistance member, and a wind resistance member. The rotating member has an axle rotatably disposed on the frame, an assembly seat fixedly disposed on the axle, and a magnetic wheel detachably disposed on the assembly seat. The magnetic resistance member is disposed on the frame, is located out of the magnetic wheel, and has an adjusting seat disposed on the frame and multiple magnetic elements. The magnetic wheel is inserted into an inner space of the adjusting seat. The magnetic elements are disposed in the adjusting seat and are located in the inner space of the adjusting seat. The wind resistance member is detachably disposed on an outer surface of the magnetic wheel. The wind resistance member and the magnetic resistance member are independent and can be detached individually.

6 Claims, 8 Drawing Sheets

(56) References Cited

U.S. PATENT DOCUMENTS

| | | | | |
|---|---|---|---|---|
| 10,376,735 | B2 * | 8/2019 | Bates | A63B 21/00192 |
| 2004/0102292 | A1 * | 5/2004 | Pyles | A63B 21/0051<br>482/54 |
| 2015/0057130 | A1 * | 2/2015 | Lin | A63B 21/0051<br>482/72 |
| 2016/0346595 | A1 * | 12/2016 | Dalebout | A63B 22/0012 |
| 2018/0036574 | A1 * | 2/2018 | Schacht | A63B 69/16 |
| 2018/0111034 | A1 * | 4/2018 | Watterson | A63B 71/0622 |
| 2018/0117383 | A1 * | 5/2018 | Workman | A63B 21/00069 |

* cited by examiner

RESISTANCE ADJUSTING APPARATUS WITH WIND RESISTANCE AND MAGNETIC RESISTANCE

BACKGROUND OF THE INVENTION

1. Field of the Invention

The invention relates to a resistance adjusting apparatus, and more particularly to a resistance adjusting apparatus with wind resistance and magnetic resistance that is easy to assemble and repair.

2. Description of Related Art

As the awareness for exercise and fitness becomes more and more popular, fitness equipment has been developing in different types. For convenience of indoor exercise, an exercise bike or a rowing machine becomes popular fitness equipment. Furthermore, the fitness equipment has two kinds of resistance sources for increasing the training effect.

Take the exercise bike for example. The exercise bike has a frame, a pedal assembly, a resistance adjusting apparatus, and a chain. The pedal assembly is mounted on the frame. The resistance adjusting apparatus is rotatably mounted on the frame and has an axle, an outer wheel, multiple wind resistance plates, a magnetic wheel, and multiple magnetic blocks. The axle is rotatably mounted on the frame. The outer wheel is disposed on the axle. The wind resistance plates are formed on an outer edge of the outer wheel at spaced intervals. The magnetic wheel is fixedly disposed on an inner side of the outer wheel. The magnetic blocks are adjustably disposed on the axle and are located in the magnetic wheel. The chain is connected to the pedal assembly and the resistance adjusting apparatus. Wind resistance is provided by the wind resistance plates of the exercise bike. Magnetic resistance is provided by the magnetic wheel and the magnetic blocks of the exercise bike.

A user may pedal the pedal assembly for exercising and adjust the magnetic blocks to move close to or away from the magnetic wheel for adjusting a riding intensity of the exercise bike. The user can feel the wind resistance and the magnetic resistance simultaneously.

However, the magnetic wheel is fixedly disposed on the outer wheel. The resistance adjusting apparatus is hard to detach from the frame. When the wind resistance plates are used after a long time and are damaged or broken, the outer wheel has to change to a new one. When the magnetic wheel or the magnetic blocks are used after a long time and attract iron filings, the magnetic resistance is decreased, and the magnetic wheel needs replacement. The outer wheel and the magnetic wheel are hard to detach. Moreover, the wind resistance plates are integrated with the outer wheel, and the outer wheel and the magnetic wheel both have to be detached. The user cannot only detach a damaged part of the resistance adjusting apparatus. The replacement cost of the resistance adjusting apparatus is increased. In addition, the magnetic blocks are located in the magnetic wheel and are hard to repair and replace.

To overcome the shortcomings, the present invention provides a resistance adjusting apparatus with wind resistance and magnetic resistance to obviate the aforementioned problems.

SUMMARY OF THE INVENTION

The objective of the invention is to provide a resistance adjusting apparatus with wind resistance and magnetic resistance to facilitate ease in repair and replacement, and reduce the replacement cost.

The resistance adjusting apparatus with wind resistance and magnetic resistance is disposed on a frame, and has a rotating member, a magnetic resistance member, and a wind resistance member. The rotating member has an axle, an assembly seat, and a magnetic wheel. The axle is rotatably disposed on the frame. The assembly seat is fixedly disposed on the axle. The magnetic wheel is detachably disposed on the assembly seat and has an outer surface. The magnetic resistance member is swingably disposed on the frame, is located out of the magnetic wheel, and has an adjusting seat and multiple magnetic elements. The adjusting seat is swingably disposed on the frame and has an inner space formed in the adjusting seat. The magnetic wheel is inserted into the inner space of the adjusting seat. The magnetic elements are disposed in the adjusting seat and are located in the inner space of the adjusting seat. The wind resistance member is detachably disposed on the outer surface of the magnetic wheel.

In the resistance adjusting apparatus with wind resistance and magnetic resistance, the wind resistance member is detachably disposed on the outer surface of the magnetic wheel, and the wind resistance member can be conveniently detached from the magnetic wheel for repair and replacement easily. The magnetic resistance member is disposed on the frame and is located out of the magnetic wheel. The magnetic resistance member is convenient to repair, replace, and assemble. The wind resistance member and the magnetic resistance member are independent and can be detached and assembled individually. The replacement cost of the wind resistance member and the magnetic resistance member is decreased effectively.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
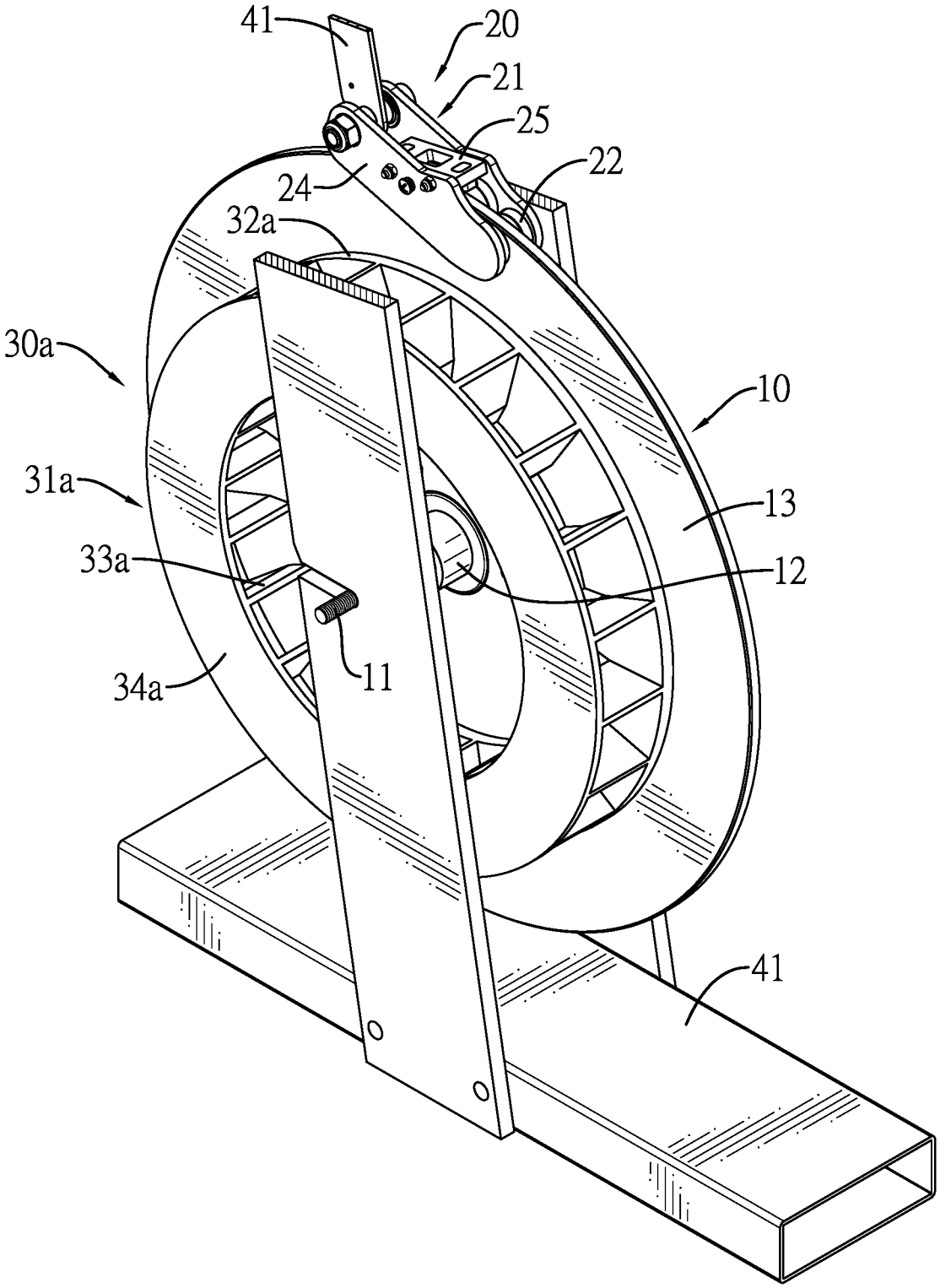
FIG. 1 is a perspective view of a first embodiment of a resistance adjusting apparatus with wind resistance and magnetic resistance in accordance with the present invention.
Figure 2:
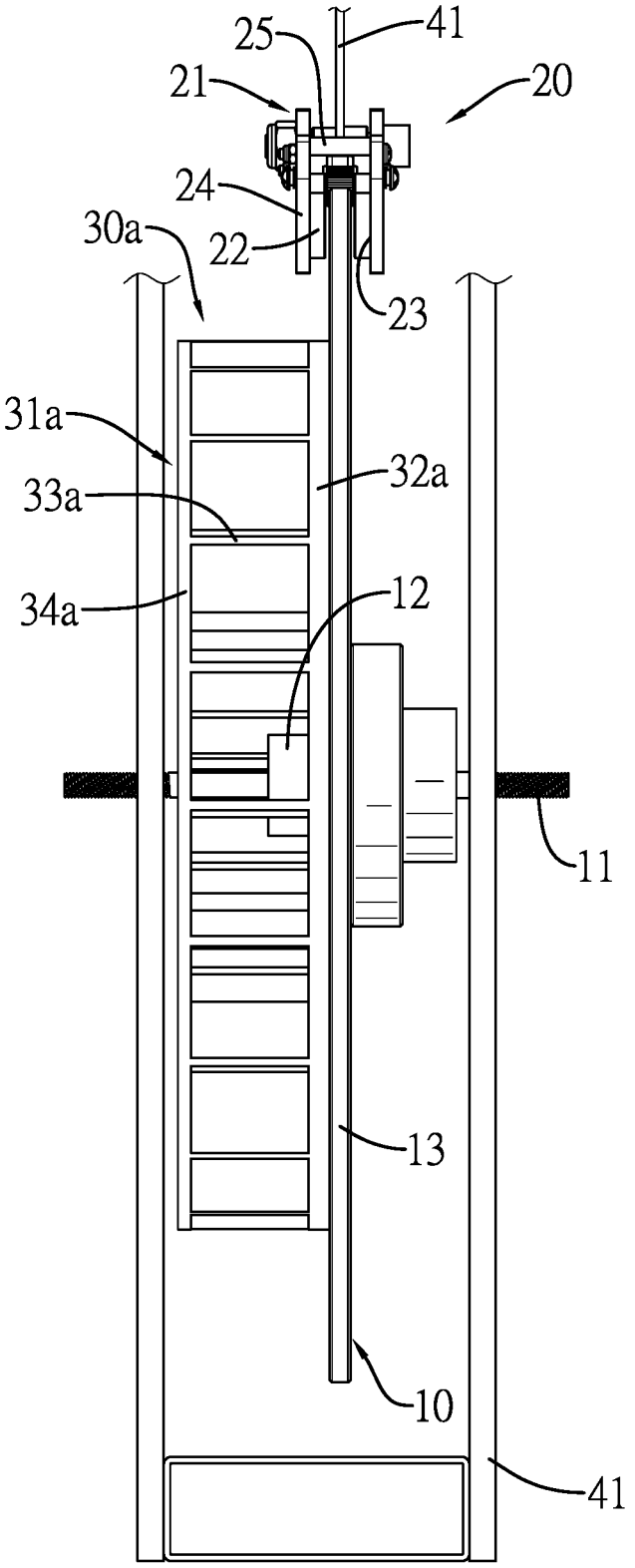
FIG. 2 is a front side view of the resistance adjusting apparatus with wind resistance and magnetic resistance in FIG. 1.

With reference to FIGS. 1 and 2, a first embodiment of a resistance adjusting apparatus with wind resistance and magnetic resistance in accordance with the present invention is disposed on a frame 41, and comprises a rotating member 10, a magnetic resistance member 20, and a wind resistance member 30*a*.

The rotating member 10 has an axle 11, an assembly seat 12, and a magnetic wheel 13. The axle 11 is rotatably disposed on and inserted through the frame 11. The assembly seat 12 is fixedly disposed on the axle 11. The magnetic wheel 13 is detachably disposed on the assembly seat 12 and has an outer surface.

The magnetic resistance member 20 is swingably disposed on the frame 41, is located out of the magnetic wheel 13, and has an adjusting seat 21 and multiple magnetic elements 22. The adjusting seat 21 is swingably disposed on the frame 41 and has an inner space 23 formed in the adjusting seat 21. The magnetic wheel 13 is inserted into the inner space 23 of the adjusting seat 21. The magnetic elements 22 are disposed in the adjusting seat 21 and are located in the inner space 23 of the adjusting seat 21. In addition, the adjusting seat 21 has two side plates 24 and a connecting block 25. The two side plates 24 are spaced apart from each other at an interval and are swingably disposed on the frame 41 beside the magnetic wheel 13. The connecting block 25 is disposed between and is connected to the side plates 24 above the magnetic wheel 13. Furthermore, the magnetic elements 22 are detachably disposed in the adjusting seat 21.

The wind resistance member 30*a* is detachably disposed on the outer surface of the magnetic wheel 13. With reference to FIGS. 1 and 2, the wind resistance member 30*a* has a turbine 31*a*. The turbine 31*a* is disposed on one of two sides of the magnetic wheel 13, and has a base 32*a*, multiple wings 33*a*, and a pressurized plate 34*a*. The base 32*a* is disposed on said one of the two sides of the magnetic wheel 13 by screws. The wings 33*a* are annularly disposed on the base 32*a* at spaced intervals. The pressurized plate 34*a* is disposed on the wings 33*a* and is opposite to the base 32*a*. Then, the wings 33*a* are disposed between the base 32*a* and the pressurized plate 34*a*.

Figure 3:
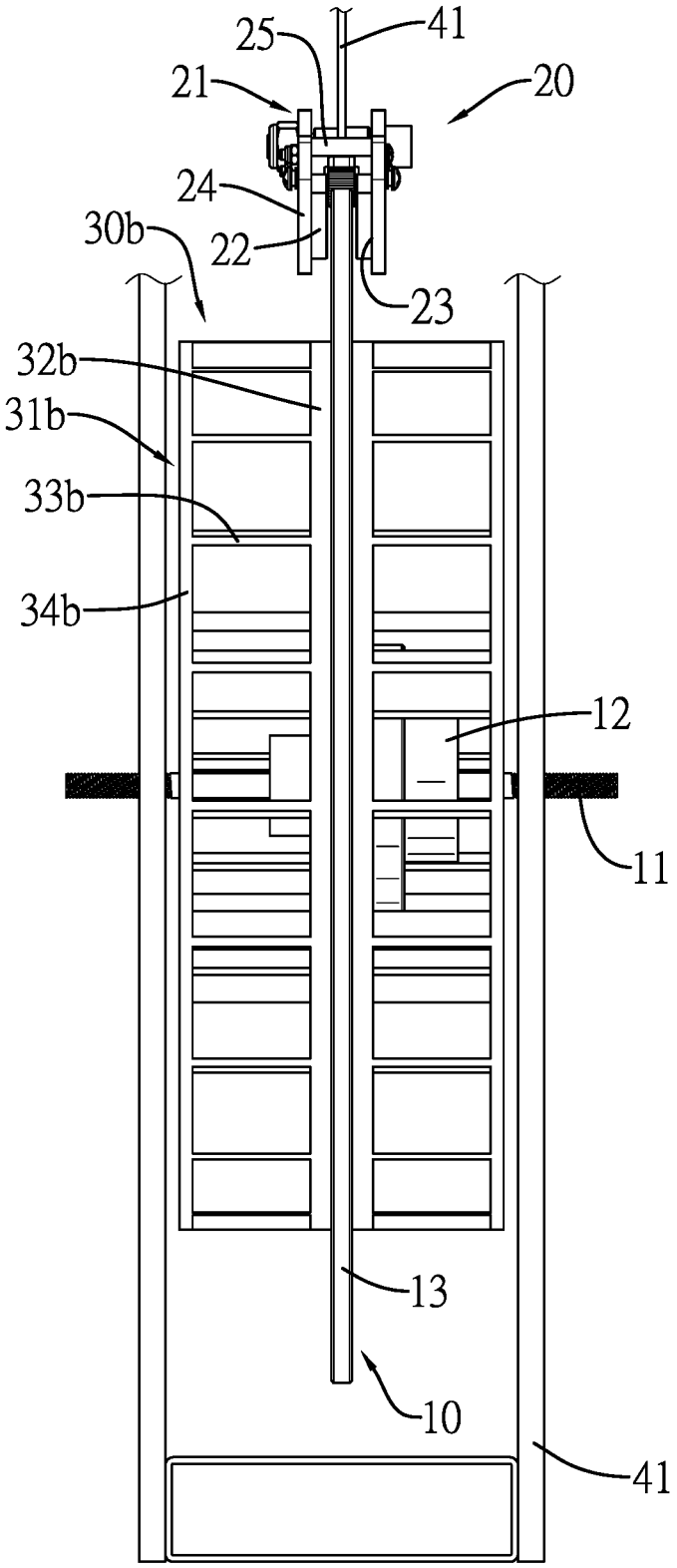
FIG. 3 is a front side view of a second embodiment of a resistance adjusting apparatus with wind resistance and magnetic resistance in accordance with the present invention.

With reference to FIG. 3, in the second embodiment, the wind resistance member 30*b* has two turbines 31*b*. The two turbines 31*b* are respectively disposed on the two sides of the magnetic wheel 13. Each turbine 31*b* has a base 32*b*, multiple wings 33*b*, and a pressurized plate 34*b*. The base 32*b* is disposed on one of the two sides of the magnetic wheel 13 by screws. The wings 33*b* are annularly disposed on the base 32*b* at spaced intervals. The pressurized plate 34*b* is disposed on the wings 33*b* and is opposite to the base 32*b*.

Figure 4:
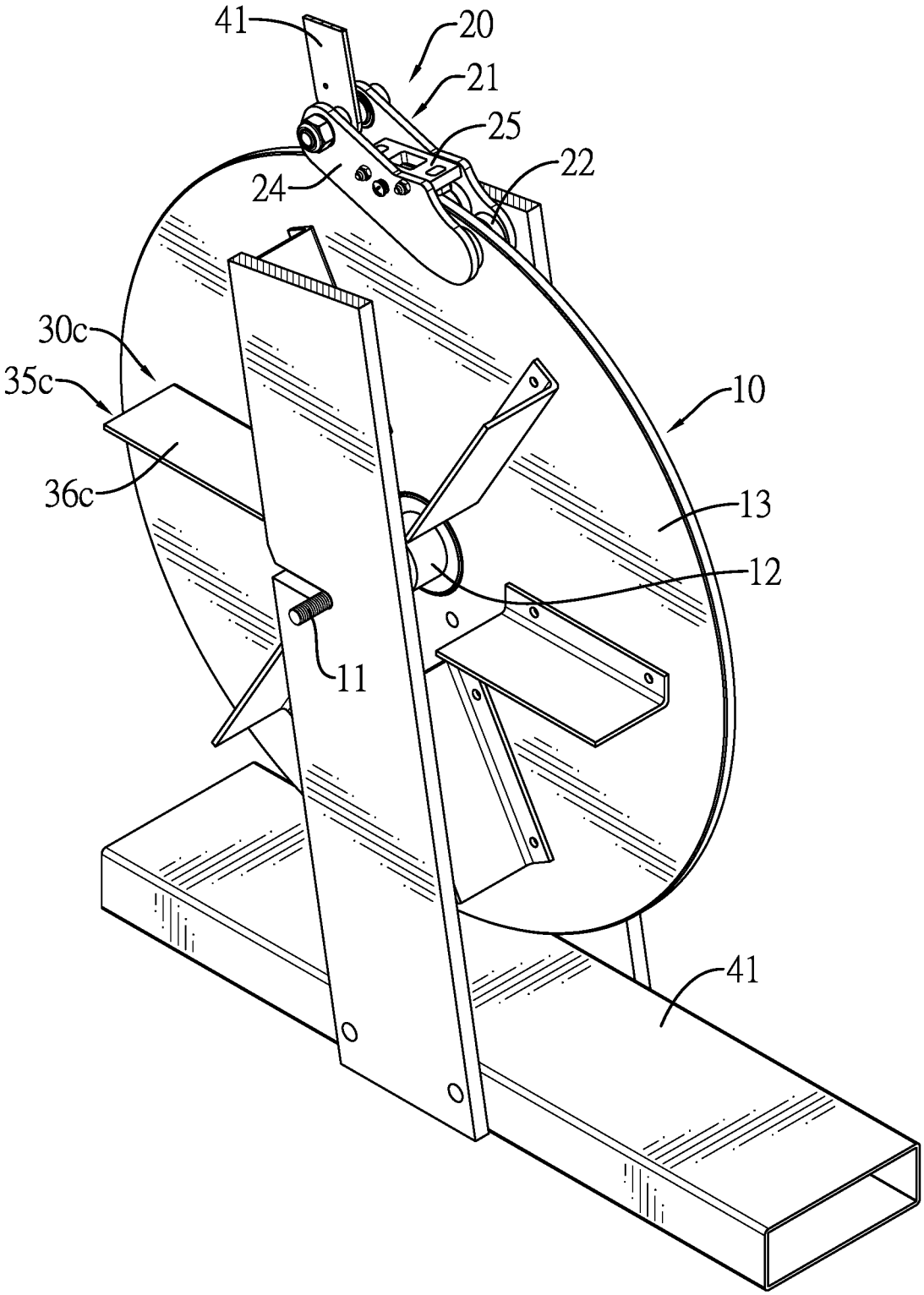
FIG. 4 is a perspective view of a third embodiment of a resistance adjusting apparatus with wind resistance and magnetic resistance in accordance with the present invention.
Figure 5:
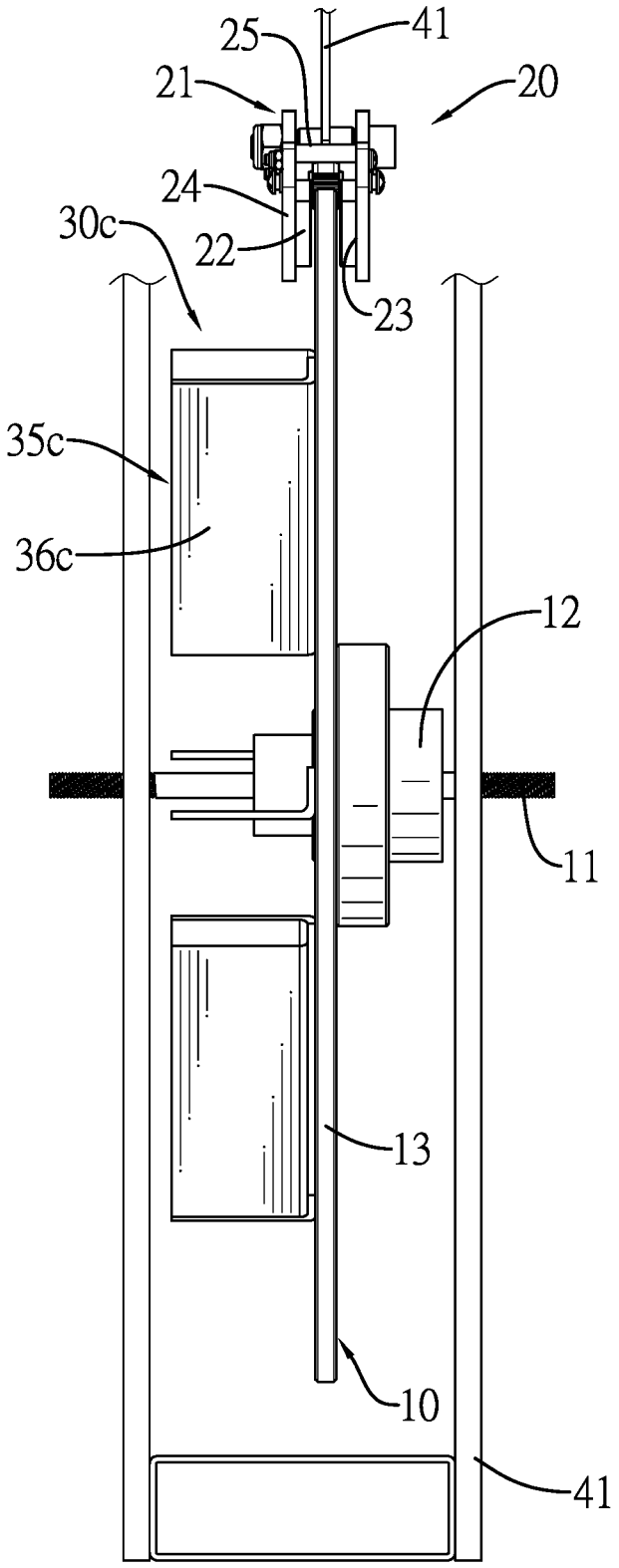
FIG. 5 is a front side view of the resistance adjusting apparatus with wind resistance and magnetic resistance in FIG. 4.

With reference to FIGS. 4 and 5, in the third embodiment, the wind resistance member 30*c* has a fan 35*c*. The fan 35*c* is disposed on one of the two sides of the magnetic wheel 13 and has multiple wings 36*c*. The wings 36*c* are annularly disposed on the magnetic wheel 13 at spaced intervals by screws.

Figure 6:
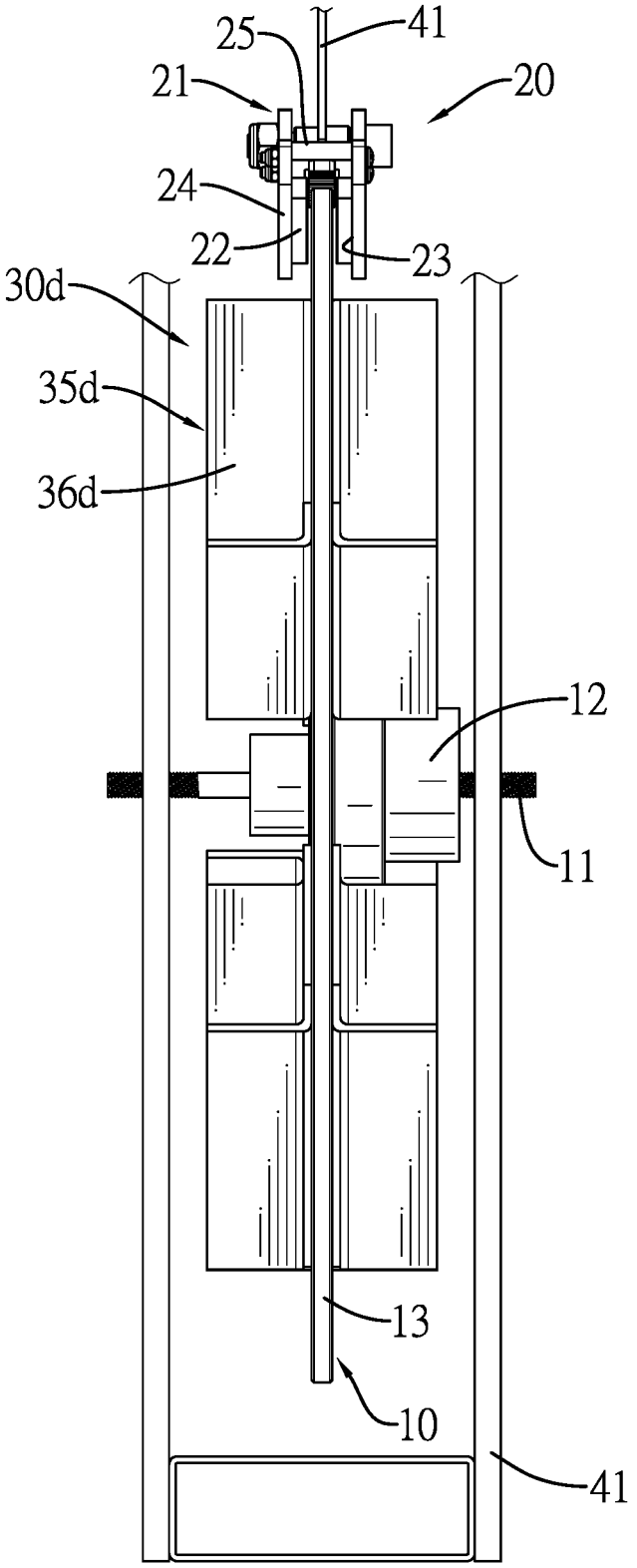
FIG. 6 is a front side view of a fourth embodiment of a resistance adjusting apparatus with wind resistance and magnetic resistance in accordance with the present invention.

With reference to FIG. 6, in the fourth embodiment, the wind resistance member 30*d* has two fans 35*d*. The two fans 35*d* are respectively disposed on the two sides of the magnetic wheel 13. Each fan 35*d* has multiple wings 36*d*. The wings 36*d* are annularly disposed on the magnetic wheel 13 at spaced intervals by screws.

Figure 7:
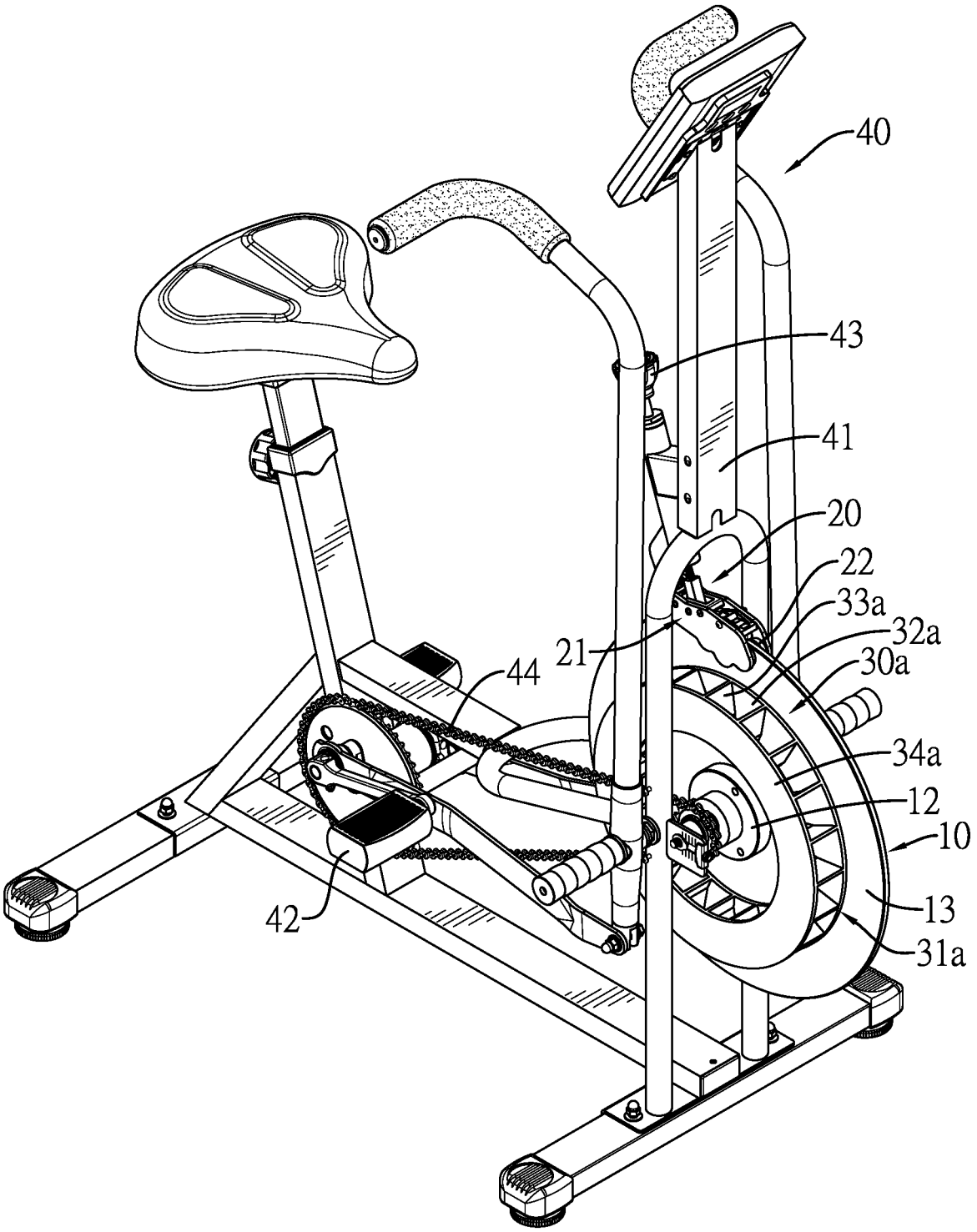
FIG. 7 is an operational perspective view of the resistance adjusting apparatus with wind resistance and magnetic resistance in FIG. 1, showing the resistance adjusting apparatus is disposed on an exercise bike.
Figure 8:
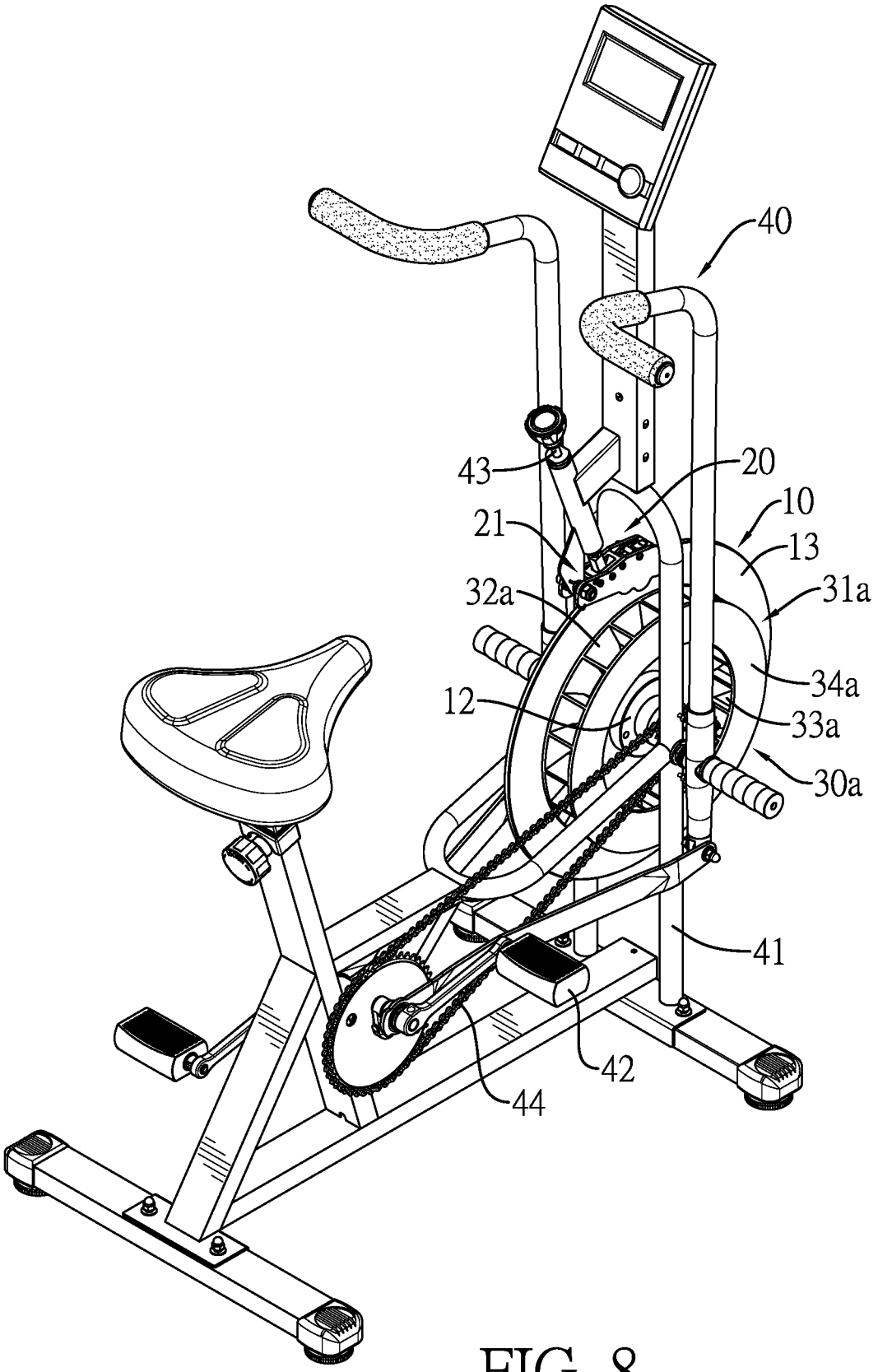
FIG. 8 is another operational perspective view of the resistance adjusting apparatus with wind resistance and magnetic resistance in FIG. 1, showing the resistance adjusting apparatus is disposed on the exercise bike.

With reference to FIGS. 2, 7, and 8, in the first embodiment, the resistance adjusting apparatus with wind resistance and magnetic resistance is disposed on the frame 41 of an exercise bike 40. The exercise bike 40 has the frame 41, a pedal assembly 42, an adjusting rod 43, and a connecting member 44. The pedal assembly 42 is disposed on the frame 41. The adjusting rod 43 is moveably disposed on the frame 41 and is connected to the connecting block 25 of the adjusting seat 21. The connecting member 44 is disposed on the pedal assembly 42 and is connected to the assembly seat 12. The connecting block 25 may be moved toward or away from the magnetic wheel 13 by controlling the adjusting rod 43 for adjusting a distance between the magnetic elements 22 and the magnetic wheel 13 to adjust magnetic resistance provided by the magnetic resistance member 20. A rotating speed of the magnetic wheel 13 can be adjusted by the magnetic resistance provided by the magnetic resistance member 20.

In use, the pedal assembly 42 is pedaled by a user for driving the assembly seat 12 to rotate by the connecting member 44. The axle 11 and the magnetic wheel 13 are rotated together with the assembly seat 12. The wind resistance member 30*a* is rotated with the magnetic wheel 13. When the wind resistance member 30*a* and the magnetic wheel 13 are rotated, the wind resistance of the wind resistance member 30*a* is increased by the wings 33*a* of the wind resistance member 30*a*. The rotating speed of the magnetic wheel 13 may be decreased. A rotating speed of the assembly seat 12 is decreased, too. Simultaneously, the magnetic wheel 13 can be attracted by the magnetic elements 22 on the adjusting seat 21 for decreasing the rotating speed of the magnetic wheel 13 to decrease the rotating speed of the assembly seat 12 and increase the magnetic resistance. The magnetic resistance acts on the pedal assembly 42 by the connecting member 44. The user can feel the magnetic resistance that is provided by pedaling the pedal assembly 42.

The wind resistance member 30*a* is detachably disposed on the outer surface of the magnetic wheel 13. When the wind resistance member 30*a* is damaged after a long time of use, the wind resistance member 30*a* can be detached from the outer surface of the magnetic wheel 13. In addition, the magnetic wheel 13 is detachably disposed on the assembly seat 12. When the magnetic wheel 13 is damaged, the magnetic wheel 13 can be directly detached from the assembly seat 12. In addition, the magnetic resistance member 20 is located out of the magnetic wheel 13, and the magnetic elements 22 are detachably disposed in the adjusting seat 21. When the magnetic elements 22 are damaged, the magnetic elements 22 can be detached from the adjusting seat 21 for convenience in repair or replacement.

The wind resistance member 30*a*, the magnetic wheel 13, and the magnetic elements 22 can be detached individually. It is not necessary to replace the whole resistance adjusting apparatus. Therefore, the assembly flexibility of the resistance adjusting apparatus in the present invention is good, and a replacement cost of the resistance adjusting apparatus is decreased. In addition, the magnetic resistance member 20 can be located around and out of the magnetic wheel 13 for decreasing the assembly limitation of the magnetic resistance member 20.

Accordingly, in the resistance adjusting apparatus with wind resistance and magnetic resistance, the wind resistance member 30*a*, 30*b*, 30*c*, 30*d* is detachably disposed on the outer surface of the magnetic wheel 13. The wind resistance member 30*a*, 30*b*, 30*c*, 30*d* is conveniently detached from the magnetic wheel 13 for ease in repair and replacement. Furthermore, the magnetic resistance member 20 is disposed on the frame 41 and is located out of the magnetic wheel 13 for convenience in repair, replacement, and assembly. The wind resistance member 30*a*, 30*b*, 30*c*, 30*d* and the magnetic resistance member 20 are independent, and can be detached and assembled individually. The replacement cost of the wind resistance member 30*a*, 30*b*, 30*c*, 30*d* and the magnetic resistance member 20 is decreased effectively.

What is claimed is:

1. A resistance adjusting apparatus with wind resistance and magnetic resistance, adapted to be disposed on a frame, and comprising:

a rotating member having an axle rotatably disposed on the frame;

an assembly seat fixedly disposed on the axle; and a magnetic wheel detachably disposed on the assembly seat and having an outer surface;

a magnetic resistance member swingably disposed on the frame, located out of the magnetic wheel, and having an adjusting seat swingably disposed on the frame and having an inner space formed in the adjusting seat, wherein the magnetic wheel is inserted into the inner space of the adjusting seat; and multiple magnetic elements disposed in the adjusting seat and located in the inner space of the adjusting seat; and a wind resistance member detachably disposed on the outer surface of the magnetic wheel; wherein the wind resistance member comprises a fan having multiple wings annularly disposed around the magnetic wheel at spaced intervals.

2. The resistance adjustment apparatus with wind resistance and magnetic resistance as claimed in claim 1, wherein the magnetic wheel has two sides and the fan is disposed on one of the two sides of the magnetic wheel.

3. The resistance adjusting apparatus with wind resistance and magnetic resistance as claimed in claim 2, wherein the adjusting seat has two side plates and a connecting block, the two side plates are spaced apart from each other at an interval and are swingably disposed on the frame beside the magnetic wheel, and the connecting block is disposed between and is connected to the side plates above the magnetic wheel.

4. The resistance adjustment apparatus with wind resistance and magnetic resistance as claimed in claim 1, wherein the magnetic wheel has two sides, the wind resistance member further comprising another fan having multiple wings annularly disposed on the magnetic wheel at spaced intervals, the fans are respectively disposed on the two sides of the magnetic wheel.

5. The resistance adjusting apparatus with wind resistance and magnetic resistance as claimed in claim 4, wherein the adjusting seat has two side plates and a connecting block, the two side plates are spaced apart from each other at an interval and are swingably disposed on the frame beside the magnetic wheel, and the connecting block is disposed between and is connected to the side plates above the magnetic wheel.

6. The resistance adjusting apparatus with wind resistance and magnetic resistance as claimed in claim 1, wherein the adjusting seat has two side plates and a connecting block, the two side plates are spaced apart from each other at an interval and are swingably disposed on the frame beside the magnetic wheel, and the connecting block is disposed between and is connected to the side plates above the magnetic wheel.

* * * * *